US009347723B2

(12) United States Patent
Burdine et al.

(10) Patent No.: US 9,347,723 B2
(45) Date of Patent: May 24, 2016

(54) METHOD AND APPARATUS FOR WEAPON CONTROL AND AUTHORIZATION

(71) Applicants: Robert Van Burdine, Ardmore, TN (US); Dorothy Devine Burdine, Ardmore, TN (US); Alfred Lee Devine, Bumpass, VA (US)

(72) Inventors: Robert Van Burdine, Ardmore, TN (US); Dorothy Devine Burdine, Ardmore, TN (US); Alfred Lee Devine, Bumpass, VA (US)

(73) Assignee: Area Denial Systems, LLC, Ardmore, TN (US)

( * ) Notice: Subject to any disclaimer, the term of this patent is extended or adjusted under 35 U.S.C. 154(b) by 0 days.

(21) Appl. No.: 14/142,874

(22) Filed: Dec. 29, 2013

(65) Prior Publication Data

US 2015/0184962 A1 Jul. 2, 2015

(51) Int. Cl.

| | |
|---|---|
| ***F41A 17/00*** | (2006.01) |
| ***F41A 17/06*** | (2006.01) |
| ***G07C 9/00*** | (2006.01) |
| *A47B 81/00* | (2006.01) |

(52) U.S. Cl.
CPC ..... *F41A 17/063* (2013.01); *G07C 9/00039* (2013.01); *G07C 9/00071* (2013.01); *A47B 81/00* (2013.01)

(58) Field of Classification Search
CPC ..... F41A 17/006; F41A 17/20
USPC ..... 42/70.01, 70.11
See application file for complete search history.

(56) References Cited

U.S. PATENT DOCUMENTS 6,260,300 B1 * 7/2001 Klebes ..... F41A 17/066 206/317
2014/0366419 A1 * 12/2014 Allan ..... F41A 17/06 42/70.06

* cited by examiner

*Primary Examiner* — Samir Abdosh

(57) ABSTRACT

Apparatus for authorizing and de-authorizing a device such as a weapon is disclosed. The apparatus includes the electrical detection of a signal on the skin of the user, and optionally a radio signal from a central authorizing authority and the entering of a security code by the user. Upon receipt of the correct input, the weapon authorizes and is ready for use. If a loss of skin signal occurs, the weapon enters a safe state until reauthorized. Apparatus for generating the skin signal from both an ingestible and a skin-mounted apparatus are disclosed.

13 Claims, 14 Drawing Sheets

METHOD AND APPARATUS FOR WEAPON CONTROL AND AUTHORIZATION

CROSS-REFERENCE TO RELATED APPLICATIONS

This application claims benefit of U.S. Provisional Patent Application No. 61/747,571 filed on Dec. 31, 2012 and entitled "METHOD AND APPARATUS FOR WEAPON CONTROL AND AUTHORIZATION," in the names of Robert Van Burdine, Dorothy Devine Burdine and Alfred Lee Devine, which is hereby incorporated by reference in its entirety.

BACKGROUND OF THE INVENTION

This invention relates to control and authorization for use of a device such as a weapon, and in particular to the apparatus and method for weapons control and authorization at the individual or group level, particularly in structured environments such as schools and military establishments.

This invention also relates to control and authorization for use, and in particular to the apparatus and method for control and authorization at the individual or group level, particularly in structured environments such as schools, military establishments, commercial vehicle operation and controlled living facilities.

Schools and other institutions where people regularly come and go are occasionally subject to assault by one or more armed assailants. While these attacks are rare in the United States, in other countries such as Israel, the incidence can be much higher. The results of such attacks are devastating, often resulting in the deaths of children and personnel. There is a clear consensus of the need to limit or prevent these attacks.

Some have advocated the use of armed guards, or even armed teachers, as a means of stopping such attacks before they can proceed to their devastating end. Others point to the issues of introducing weapons into the classroom environment.

School shootings clearly have a political impact, spurring some to ask for more stringent gun control laws. In the United States, the National Rifle Association is opposed to such laws, and some groups have called for fewer gun control laws in general, citing cases of armed students ending shootings and halting further loss of life, and claiming that the prohibitions against carrying a gun in schools do not deter the gunmen. They point to cases such as shootings at Columbine and Red Lake High Schools, where the presence of an armed police officer alone did not prevent the shootings.

Areas in the US have allowed "armed classrooms" in an attempt to deter or truncate future attacks, presumably by changing helpless victims into armed defenders. In 2008, Harrold Independent School District in Texas became the first public school district in the U.S. to allow teachers with state-issued firearm-carry permits to carry their arms in the classroom; special additional training and ricochet-resistant ammunition were required for participating teachers. Students at the University of Utah have been allowed to carry permitted concealed pistols since a State Supreme Court decision in 2006. In addition to Utah, Wisconsin and Mississippi each have legislation that allow students, faculty and employees to carry concealed weapons on their public university's campuses. Other states have enacted various legislations and rules in response to the need to defend the classroom.

The issue with arming teachers is the introduction of deadly force into the classroom that is present at all times.

Control and security issues with these weapons, as well as clear regulation and authorization for the use of force remain current issues that are addressed by the present invention.

Other uses for the present invention include the control of authorization for any device such as vehicles and cook stoves. The control through authorization of times and periods for the operation of commercial transport such as over-the-road freight (18 wheelers), trains, taxis, and equipment is made possible through the present invention. Hunting regulation is facilitated by only allowing authorizable weapons and issuing authorizations for specific individuals for specific time periods. Security is provided through the present invention by the authorized use of security doors, and protection is afforded to the elderly or infirm by maintaining authorization over cook stoves and filling bath tubs that may cause a fire or water damage if inadvertently left unattended. This invention may also have applications in correctional facilities and military operations.

SUMMARY OF THE INVENTION

The invention relates to an apparatus such as a weapon that senses the contact of an individual through capacitive, inductive or resistive means, and may require a security code that is entered by the individual. When such conditions are met an apparatus such as a weapon is authorized and loss of contact with the individual de-authorizes the apparatus. In this manner an individual with a correct security code can be authorized to fire the weapon, and another individual without a security code can not fire the weapon. If the weapon is taken from an authorized individual, the momentary loss of contact with the individual is detected and the weapon de-authorizes preventing its use. The invention may be further comprised of a received signal such as a radio signal, that is received by the weapon before authorization is complete, with the loss of the radio signal de-authorizing the weapon. In this case a central authority can control the use of weapons.

The invention also relates to apparatuses that generate an authorization signal on the skin of an individual, an operable device comprising of a receiving apparatus that will enable the device to be operated only when an authorizing signal is received through contact, and further optional security apparatus comprising of a containment device that restricts access by an authorized user until authorization is given by a controlling authority. The invention enables the operation, by authorized users, of devices such as vehicles, commercial transport, mobile field artillery, industrial equipment, missiles, aircraft, security doors, cooking equipment, medical devices, and tools.

The invention further relates to apparatuses that generate an authorization signal on the skin of an individual, a weapon comprised of a receiving apparatus that will enable the weapon to be operated only when an authorizing signal is received through contact with the user, and further security apparatus comprised of a containment device that restricts access by an authorized user until authorization is given by a controlling authority. The invention enables the introduction of weapons to a weapons free environment, such as a school, during times of attack, while, during normal operations, completely restricting access.

Embodiments of the invention provide for the safe storage of weapons and authorizing devices in a weapons free structured environment such as a school or classroom, the access to these items during times of authorized use such as an attack by an armed intruder, the authorization for use of the weapons by authorized individuals, and the de-authorization of the weapons after the threat has passed, enabling a plurality of security operations to be selected and controlled under different conditions. Embodiments of the invention provide a means of containment of weapons, access to weapons, authorization of weapons for use, and de-authorization of weapons. In particular embodiments, the invention includes a means to authorize the release and use of weapons from a central or distributed source. Authorizers such as security personnel, principals, or other empowered individuals may authorize the use of the weapons according to the security plan of the establishment.

In one embodiment of the invention, an apparatus for weapons authorization, an authorization device is strapped to the user or otherwise brought into contact with the skin of the user, a security code is entered into the authorization device by the user, upon entry of a valid security code the authorizing device may optionally check for detection of an authorizing radio signal and upon signal detection authorize the individual by generating an authorization signal on the skin of the user. When the user touches an authorizable weapon, the weapon detects the authorization signal and immediately converts from a safe to a dischargeable condition. For example, when the alarm is given alerting to an intrusion into a school, an authorization is given by the principals office or security officer. This authorization allows the opening of the weapons storage by a user entering their security code. The user takes an authorization device, straps it to themselves and enters their authorization code. The authorizing device then produces an authorization signal on the skin of the user.

The now fully authorized user selects a weapon from the weapons storage that is completely operational in the authorized users hands. If the authorized user loses contact with the weapon, the weapon is no longer operational as the authorization signal has been lost. If the authorizing device is removed from the authorized user, such as by an assailant, the loss of skin contact is detected and the authorization device deactivates stopping the authorization signal. In this manner an authorization device and authorizable weapon can not be taken from an authorized user and used against them or anyone else. A proper authorization code would have to be entered to re-activate the authorization signal, and optionally a specific radio authorization from the controlling office may have to be received to re-activate. Due to this the authorized weapon can be introduced into the classroom for use against an assailant without the risk of the weapon being accessible to or usable by anyone other than a fully authorized user under fully authorized conditions.

The apparatus has particular utility in the control and accessibility of weapons in environments such as schools, military bases, prisons, psychiatric wards, shooting ranges, security areas, military peace keeping operations, and other areas where control and availability of weapons is simultaneously required.

In the case of a prison, the 1.6 million inmates housed in the correctional facilities of the United States today pose a significant threat to the 493,100 men and women tasked to keep the peace in prison. The majority of these inmates are hardened criminals, some sentenced to life behind bars who have nothing to lose. A great many of these convicted felons are bent on little more than waging war within the confines of their facilities. They spend the majority of their day looking for methods to harm those whose job it is to supervise them. Weapons are crafted from everyday objects and create a highly charged hostile work environment. Into this environment enters the correctional officer who has only their uniform and their wits to keep themselves safe while being outnumbered 200 to 1.

If the guards who are physically in with the inmates were to carry a weapon (such as a firearm or Taser), it would more than likely be taken away from them and then used against the officer or on other inmates. The ability to have a correctional officer armed with a weapon which could not be used against them in a closed environment would shift the balance of power back towards the establishment.

An example of this would be as follows: A correctional officer in the general population is armed with either a gun or a Taser and is called upon to break up a prison riot. This officer is equipped with the authorized weapon control and therefore is not in danger of losing his personal weapon in a usable condition to the inmates.

If the perpetrators of the riot were to disarm the officer, the only way the weapon could be used to hurt anyone would be as a bludgeon or as a blunt object. Additionally, the inmate who grabs the weapon and thinks he may use the weapon against the officer has now made a grave error. The fact that the firearm or Taser will not fire would disorient the inmate and could allow for the correctional officer to wrestle the perpetrator down and re-take the weapon which would be reauthorized and become functional as soon as the officer takes hold of it.

This scenario would be played out many times with the inmates never getting to use the stolen weapons. This act, over time, would deter the inmates from attempting to steal guard's weapons. This increased ability to physically stop the assault on either correctional facility personnel or other inmates in a closed environment would greatly enhance the control that the correctional facility has in the rehabilitation or incarceration of convicted felons.

This control of a weapon in a closed environment could be used in any law enforcement arena where there is the danger of an officer's weapon being taken from them and used against them or anyone else who may be in the vicinity.

In the law enforcement and correctional facility arena, an officer would have an authorization code which would activate the weapon's release for their service weapon or Taser. This would be followed by a daily code to continue to allow the officer to use their weapons whenever they are needed. If the officer is tasked with a SWAT role, then the officer would use a specific security code to allow for the use of additional more powerful weapons. This would require a monthly activation in order to allow for the officer to always be able to fire his weapon.

Another example of the use of the present invention is the ability of a state agency to control the use of a specific type of weapon during a hunting season, resulting in a much safer hunting season.

The method of this application is as follows: A civilian goes to a state controlled location or state sanctioned retailer to purchase a hunting license for a specific hunting season. Along with the required hunting tag, the proprietor also sells the hunter an authorization code which allows for the weapons authorization to last only the duration of the hunting season. If the season is to last for a three month period and the hunter has two deer tags, then the retailer provides to the hunter a security code control for a one month period. After the hunter registers his first deer "tag" at the retailer, then the hunter will then receive a second security code which will then allow the hunter to continue his hunting season.

This scenario would allow for a safety aspect which does not exist at this time. Currently, if the hunter leaves his rifle or firearm out and a young child or anyone else who might be around finds the weapon and handles it, the weapon could accidentally discharge resulting in grievous injury or even death.

Using the present invention, this tragedy could not occur. Anyone who handles the weapon and does not have the security code for the weapon control can not accidentally discharge the weapon. This assures the hunter that his family is completely safe while the hunter still has the ability to use the weapon for its intended purpose.

Additionally, with the use of the present invention, no one may steal a persons weapon and then be able to use the stolen weapon.

Finally, the present invention could be used to regulate the caliber and type of firearm that would be used in a specific hunting season. If the season requires that only a shotgun be used to hunt deer, then the weapon authorization would be geared to a shotgun for that season. This would require there be a differentiation in the controls for each caliber of weapon used by an individual hunter. This would have the added benefit in that poaching of a specific animal out of season would not be feasible.

The method in which the present invention would be utilized would vary depending on the application and occupation of the user. Each different user would need to follow a different protocol in order to utilize their weapons.

Overall, there would be an activation security code which would be active for a given period. The initial period authorization code would authorize the user to use a general weapon with an additional authorization code issued each month.

In the civilian hunting application, the user would need an activation code once a month or at the beginning of the specific hunting season with a periodic codes each day during the specific hunting season.

In a further civilian application, a homeowner who wishes to use a firearm in the defense of themselves or their residence would also have an authorization code for a given period, perhaps a year or five years. This code would be geared to the weapon which the homeowner chooses to keep as a defensive weapon. This application would also have a side benefit in that there would not be an accidental discharge by a member of the household who has not put on the authorizing device and entered the proper code.

Elderly and infirm persons may also benefit from the present invention. For example, a forgetful person may walk away and forget to maintain cognizance over cook stoves and filling bath tubs that may cause fire or water damage if inadvertently left unattended. In the case of a cook stove, the authorized individual would make contact with the authorization sensor of the cook top, and the cook top would continue to operate for a predetermined period, or variably depending on the heat level selected, shutting down if not revisited within the determined time. Programmable cook tops could be initiated by the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art, and should not be interpreted in an idealized or overly formal sense unless expressly so defined herein. Well-known functions or constructions may not be described in detail for brevity and/or clarity.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

This invention relates to authorization and control of a device, and to apparatus that can generate and accept an authorizing signal and security code, detect the presence of an authorized user, authorize a device for use, and de-authorize a device should authorization be lost. The device may be a weapon such as a gun of any type, or a vehicle where authorization is required before it can be operated. The authorized device can have any desired use, for example, a security door, a gun, a cook stove or a bath tub, and can be applicable to a wide range of environments such as a school, prison, battlefield, living facility or hospital, etc.

A particular use of the technology described here is the control and authorization of weapons in a school setting, including storing those weapons in classrooms for ready access when needed, while maintaining absolute security, authority and control of the weapons at all times.

Figure 1:
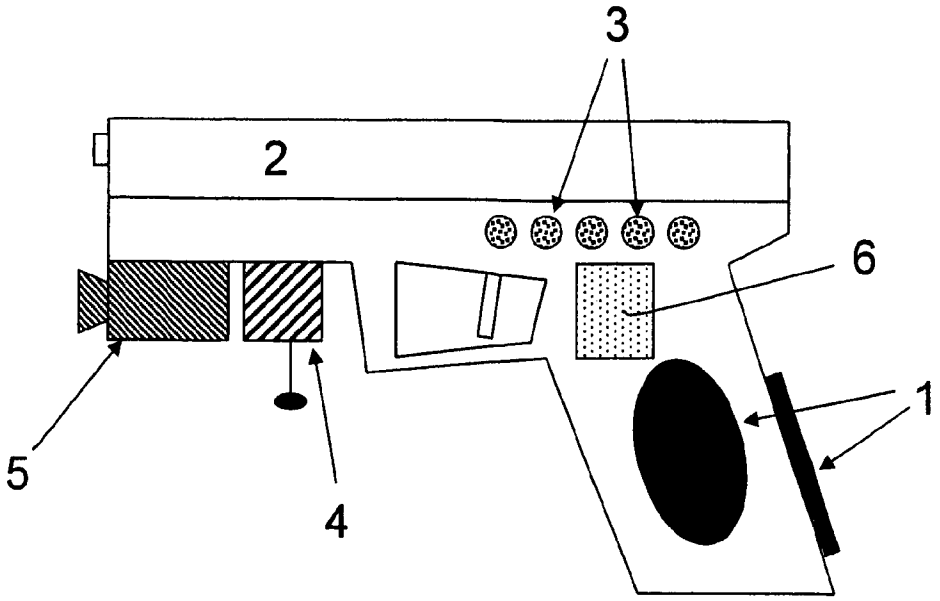
FIG. 1 is a profile view of an authorizable weapon.

An apparatus of the present invention is the authorizing device. In FIG. 1 the grips 1 connect the authorizing device 6 with the skin of the individual. The grips 1 conduct electronic information to the authorizing device 6 related to the weapon being in contact with the individual. This information may be a coded signal detected from the surface of the skin, or a capacitive, resistive or inductive signal generated by the electrical characteristics of the individual.

The individual enters a security code via the security keys 3 shown in FIG. 1. This information is sent to the authorizing device 6. When authorizing device 6 has acquired valid inputs it configures the weapon 2 to be operational. When authorizing device 6 loses a critical input, such as the grips 1 losing contact with the individuals skin causing loss of signal, authorizing device 6 configures the weapon 2 to become non-operational.

An additional input to authorizing device 6 shown in FIG. 1 is radio receiver 4. Radio receiver 4 may be used to receive a signal from a central controlling source, such as a security guard or principals office, that authorizes all or specific weapons to be authorized and operational. In this manner, a weapon may be declined authorization from a central authority that is located away from the conflict or situation.

FIG. 1 shows audio/video attachment 5 that transmits and/or records audio and/or video of the scene the weapon is directed towards. This information may be received and evaluated in real time by a central authority in command of the authorization of the weapon. In this manner, an authorized user that becomes an assailant may be prevented from committing harm. Actions taken by an authorized individual are also recorded for future analysis or use as evidence in a legal proceeding.

In FIG. 1, radio receiver 4 and audio/video attachment 5 are shown mounted externally to the weapon. It is a preferred embodiment that both are preferred to be integrated within the weapon without mechanically exposed antenna or optical trains.

The weapon 2 as depicted in FIG. 1 may be a weapon of any sort whose operation can be enabled or disabled. Such weapons as pistols, rifles, shotguns, air guns, paintball guns and devices, Tasers and other electrical or electronic weapons, electro-optical devices, and gas operated weapons are all included and referenced by this depiction and are included as preferred embodiments of the present invention. It is a preferred embodiment of the present invention that weapons such as pistols, rifles and shotguns be equipped with non-lethal or less lethal rounds.

Figure 2:
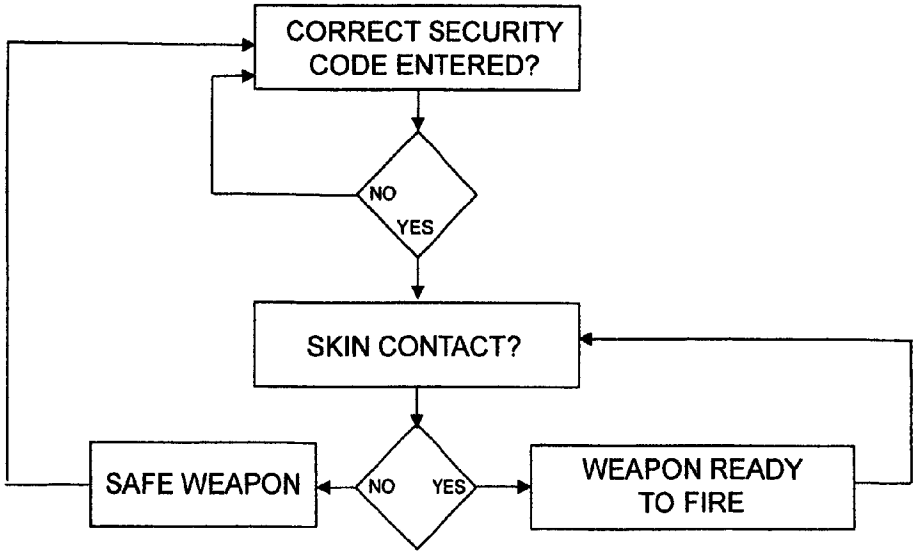
FIG. 2 is a flow chart for a method of weapon authorization.

FIG. 2 depicts the logic and method of an authorization based on two inputs: security code, and verified skin contact. If both of these inputs are met, the weapon is ready to fire. If the skin contact is lost the weapon is placed into a safe condition and can not be fired without re-authorization. In this manner if the weapon is taken from the authorized user it can not be operated without entering a proper security code.

Figure 3:
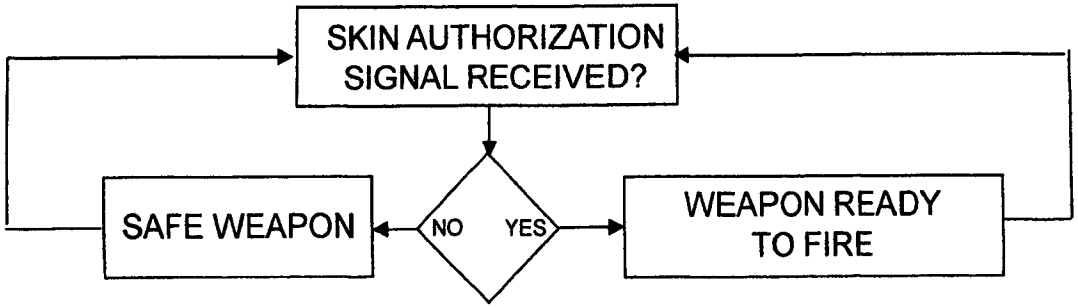
FIG. 3 is a flow chart for a method of weapon authorization.

FIG. 3 depicts the logic and method of an authorization based on one input only, the skin authorization signal. If the authorization signal is detected, the weapon is ready to fire. If the authorization signal is lost, the weapon is placed into a safe condition and can not be fired until the authorization signal is detected again. In this manner if the weapon is taken from the authorized user it can not be operated, and if it is recovered by the authorized user the weapon can be operated on contact.

Figure 4:
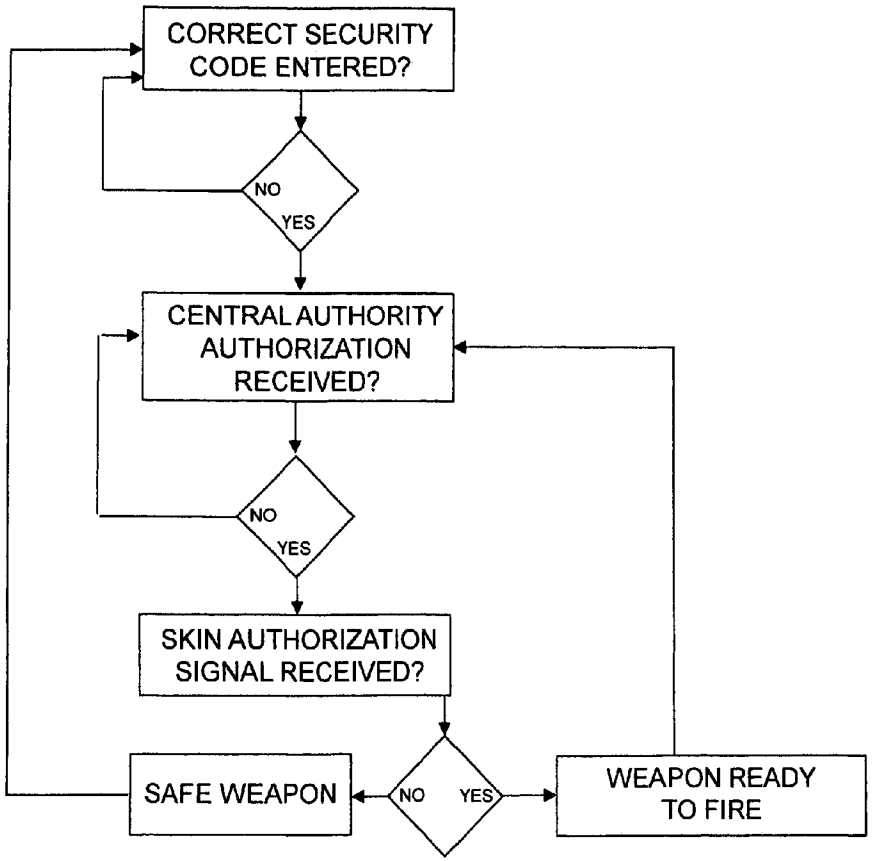
FIG. 4 is a flow chart for a method of weapon authorization.

FIG. 4 depicts the logic and method of an authorization based on three inputs: security code, central authorization, and skin authorization signal. If all of these inputs are met, the weapon is ready to fire. If the skin authorization signal is lost, the weapon is placed into a safe condition and can not be fired without re-authorization. In this manner if the weapon is taken from the authorized user it can not be operated, and if it is recovered by the authorized user the weapon can be operated on contact. The central authority can authorize and de-authorize the weapon. In this manner, a weapon may be declined authorization from a central authority that is located away from the conflict or situation.

Figure 5:
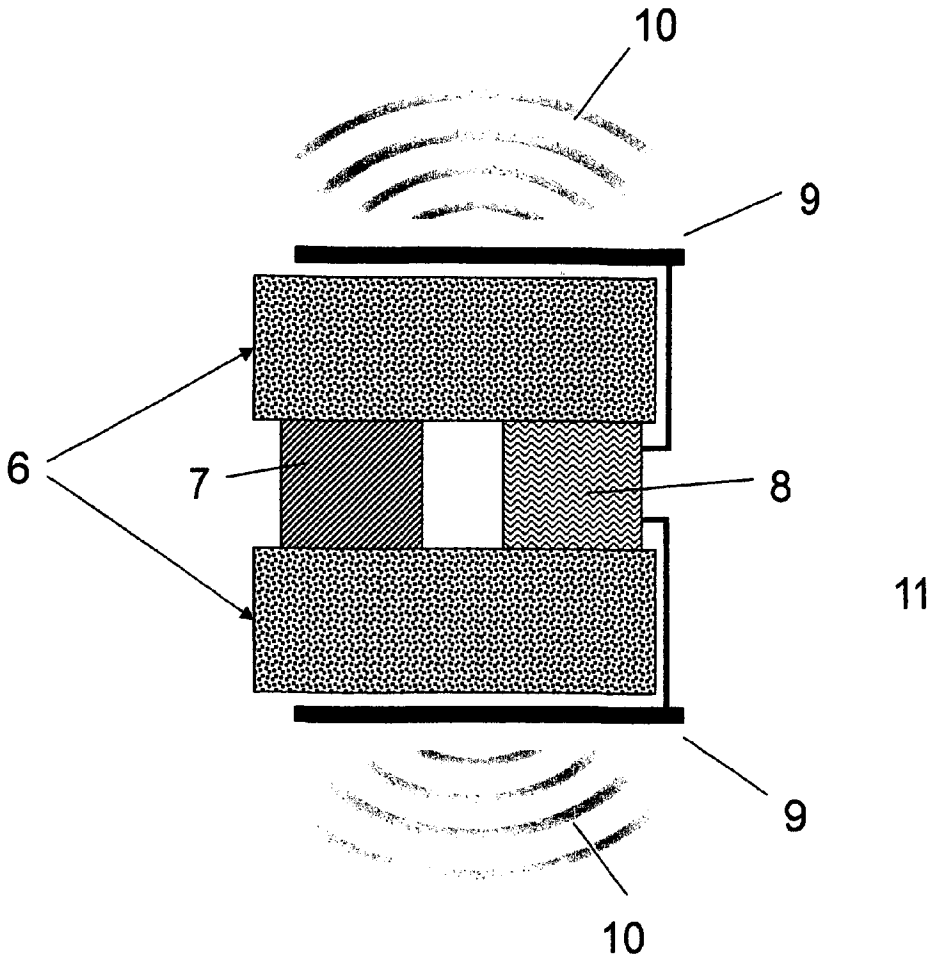
FIG. 5 is a cross-sectional view of an ingestible skin signal generator.

FIG. 5 illustrates an ingestible signal generator 11 for the generation of a skin authorization signal. This device 11 is ingested by the individual and generates a signal that appears as a skin authorization signal on the skin of the individual. Activation may be done before ingesting by turning the device on, or after ingestion through interaction with the gastric environment. A battery 6 powers a logic device 7 that is programmed to produce a given authorization signal code. That information is passed through a skin signal transmitter 8 that emits the signal 10 through signal antenna emitters 9. The signal 10 travels through the body and appears on the skin of the authorized individual.

It is a preferred embodiment that the ingestible signal generator 11 deactivate after a prescribed time. It is a preferred embodiment that the ingestible signal generator 11 remain active only so long as the transponder is maintained in a normal body environment and will deactivate upon temperature change, blood pressure loss, a detection of cessation of heartbeat, a detection of cessation of blood flow, a detection of death, a detection of loss of the prescribed liquid environment, a detection of air, the detection of light, or other changes to its environment indicating its removal from the body or the death of the individual. These functions are incorporated into logic device 7.

Ingestible signal generator 11 illustrated in FIG. 5 may be supplemented by the ingestion of other ingestible signal generators 11. These additional ingestible signal generators 11 are ingested before the previously ingested unit ceases to operate. These follow on units are configured to pick up the signal from the operating unit and activate upon the pervious units ceasing to operate. In this manner a continuous skin authorization signal may be maintained for an extend period of time.

Figure 6:
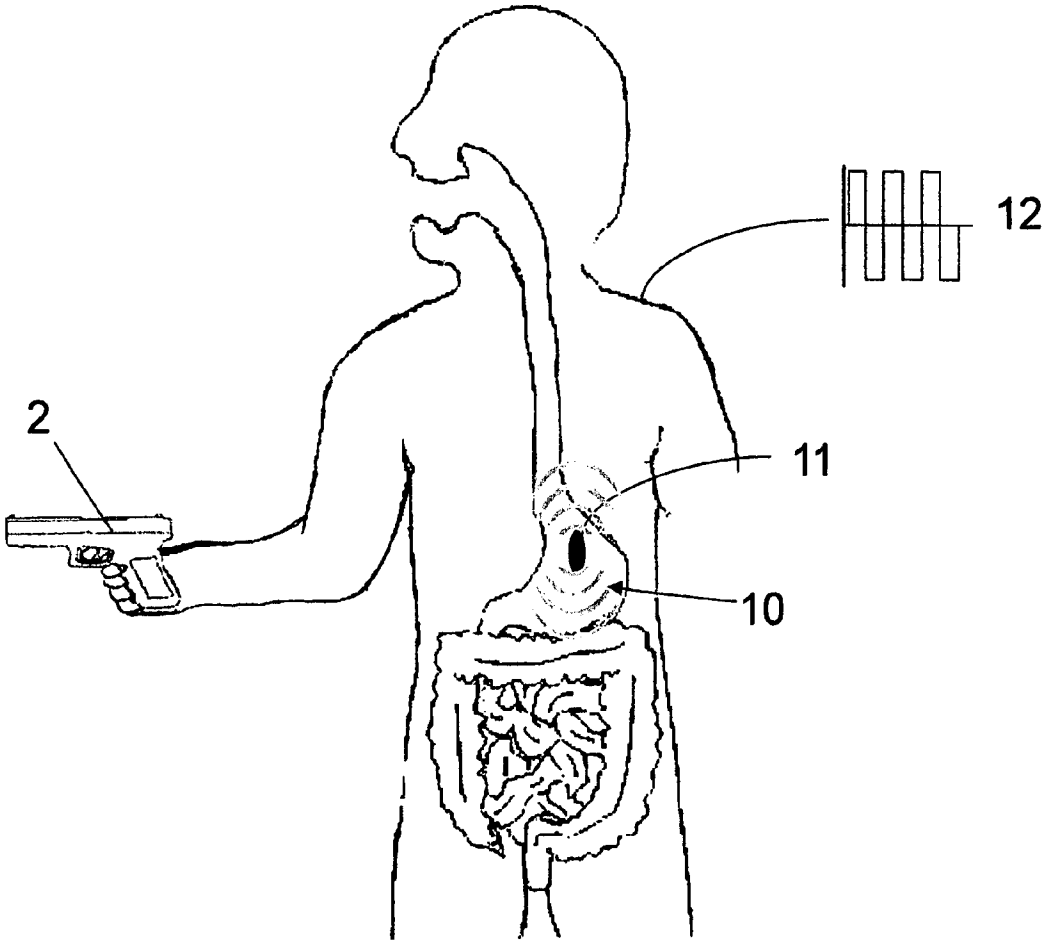
FIG. 6 is a cross-sectional view of an ingestible skin signal generator inside the stomach generating a skin signal authorizing a weapon.

FIG. 6 illustrates an individual that has ingested an ingestible signal generator 11. The ingestible signal generator 11 is sending a signal 10 through the body of the individual that appears as skin authorization signal 12. Skin authorization signal 12 is detected by weapon 2, and weapon 2 is now authorized and ready for use by the authorized individual.

Figure 7:
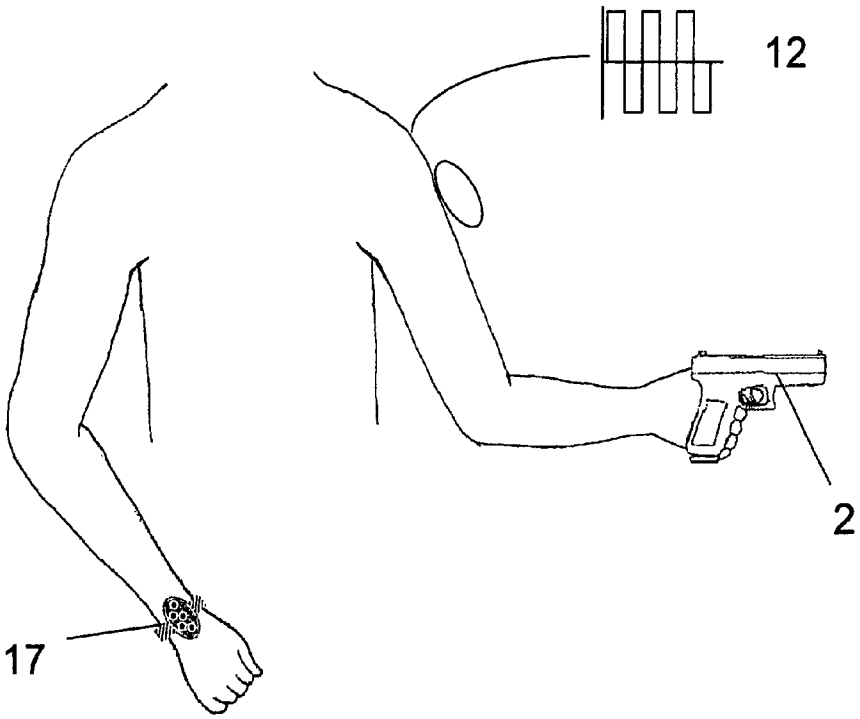
FIG. 7 is a view of a skin mounted skin signal generator mounted on a wrist generating a skin signal authorizing a weapon.

FIG. 7 illustrates an individual that is wearing a skin authorization generator 17. This device 17 generates a skin authorization signal 12 that is detected by weapon 2. In this manner a device 17 may be worn on the outside of the body in contact with the skin of the individual for the purpose of generating a skin authorization generator 17.

Figure 8:
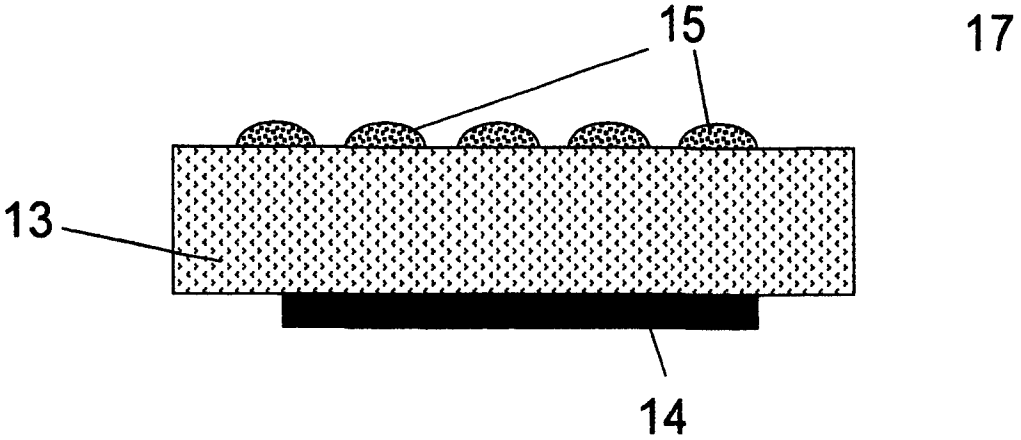
FIG. 8 is a side view of a skin mounted skin signal generator.

FIG. 8 depicts a skin authorization generator 17 in profile showing the skin interface 14, battery, signal generator and logic housing 13, and security code keys 15 for entering the users code to activate the skin authorization signal 12. Skin interface 14 is any conductor contacting the skin to facilitate the conductance of signal 10 onto the skin of the individual.

Skin interface 14 is preferred as an adhesive pad, which includes either solid or wet gel and is deemed to be self sticking to the skin. Skin interface 14 may be covered with a peel off covering that is removed by the user prior to use, or may act as a storage medium, holding the authorization generator 17 in its storage position, and being exposed ready for use when authorization generator 17 is removed for use. Skin interface 14 is preferred to be a self-adhesive, single use, foam backed carbon flexible electrode device that is replaced when the authorization generator 17 is returned to storage. In this manner a highly reliable transmission of signal 10 and a strong presentation of skin authorization signal 12 is assured.

Figure 9:
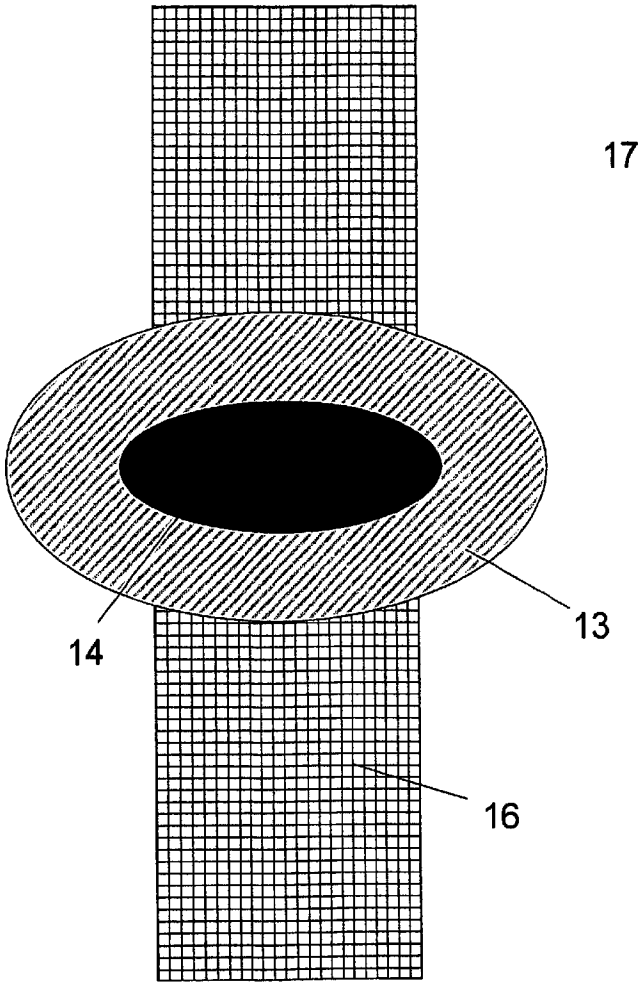
FIG. 9 is a plan view of a skin mounted skin signal generator, bottom.

FIG. 9 depicts a skin authorization generator 17, bottom view. The bottom view is shown in and is the part of the skin authorization generator 17 that wraps around and is in contact with the arm and skin of the user as shown. Skin interface 14 is shown, as is strap band 16. Strap band 16 is for the mechanical attachment and securing of authorization generator 16 to the body, and as shown here around the wrist or arm. Strap band 16 may house a ground for the signal 10 as applied by the skin interface 14 as required for the particulars of the signal.

Figure 10:
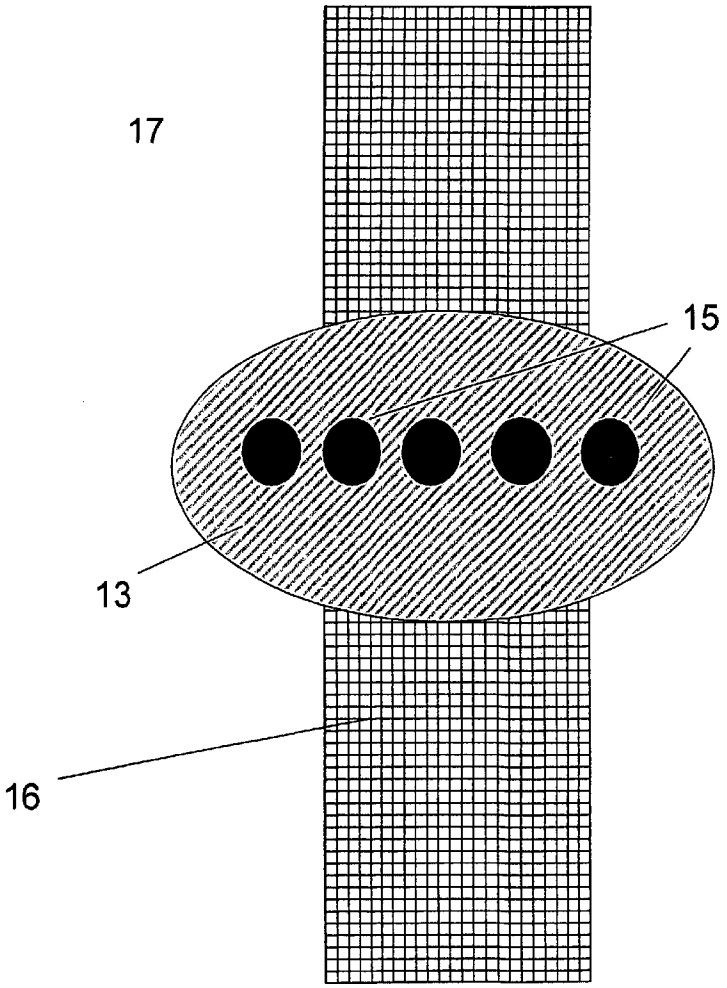
FIG. 10 is a plan view of a skin mounted generator, top.

FIG. 10 depicts the top, or outer portion of skin authorization generator 17 showing the signal generator and logic housing 13, and security code keys 15 for entering the users code to activate the skin authorization signal 12.

Skin authorization generator 17 may be connected to any part of the body, or through a conductive interface as desired. It may be configured and housed in a plurality of forms and locations such as in clothing items, shoes, boots, jewelry, watches, hats, etc.

Figure 11:
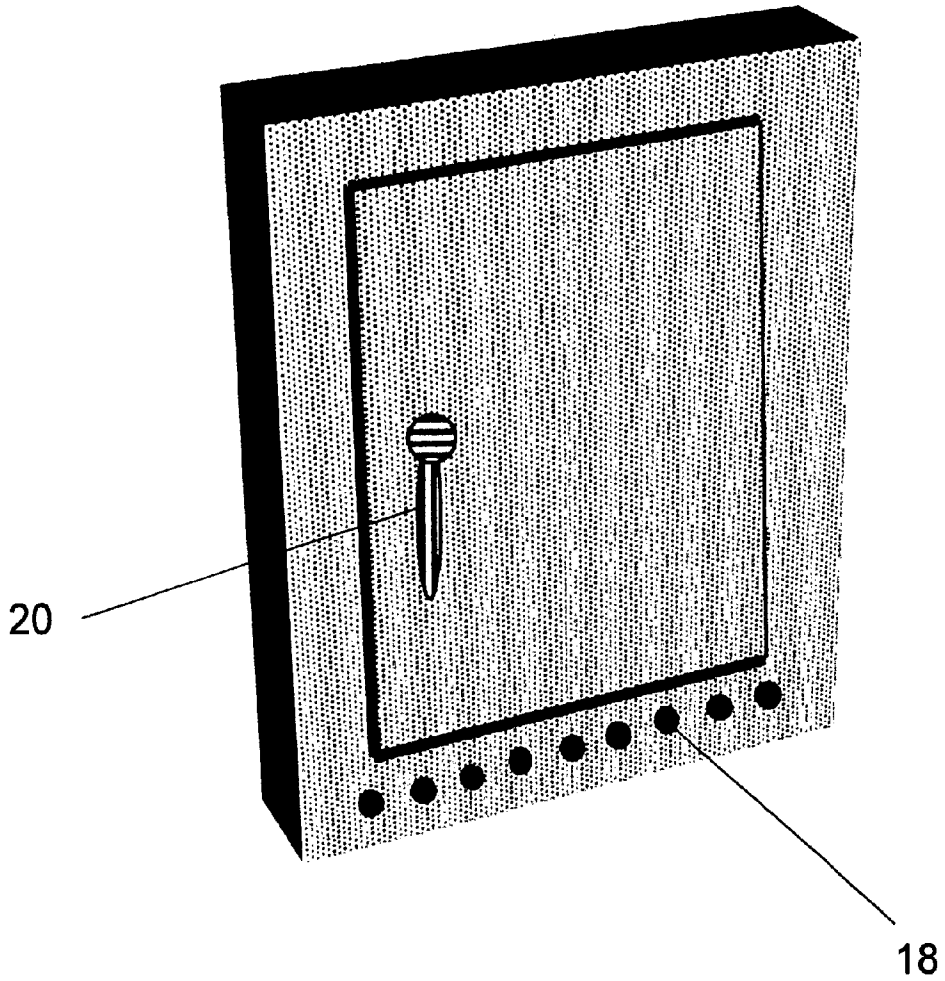
FIG. 11 is a view of a secured storage cabinet in closed condition.

FIG. 11 illustrates the secured storage cabinet 21. This cabinet securely stores authorizable weapons 2 and authorization generators 17 in places convenient for fast access in times of needs, but completely isolates, contains, and restricts access to these items at all other times. This cabinet 21 may be situated in classrooms, in a teacher's desk drawer, in a prison or other areas typically not considered for weapons storage.

Figure 12:
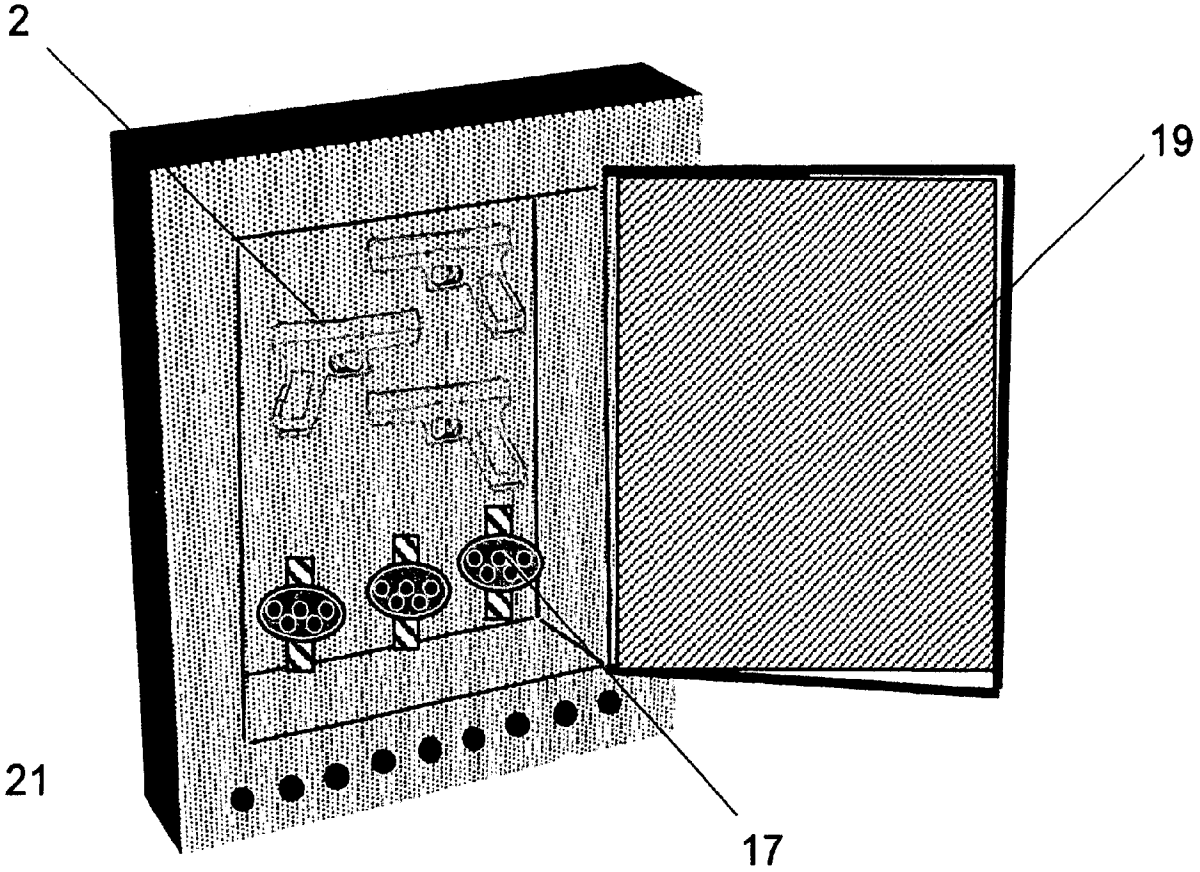
FIG. 12 is a view of a secured storage cabinet in open condition displaying the contents.

FIG. 12 illustrates the secured storage cabinet 21. This cabinet securely stores authorizable weapons 2 and authorization generators 17 in places convenient for fast access in times of needs, but completely isolates, contains, and restricts access to these items at all other times. This cabinet 21 may be situated in classrooms, in a teacher's desk drawer, in a prison or other areas typically not considered for weapons storage. In FIG. 12, the cabinet 21 is shown open displaying its load of weapons 2 and skin authorization generators 17. Cabinet 21 may be equipped with chargers to keep the contents requiring battery power to operate fully charged.

Figure 13:
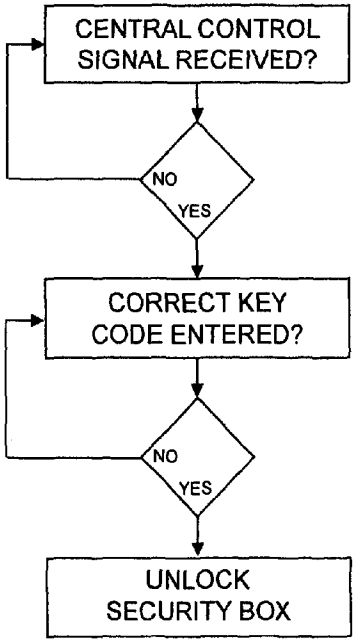
FIG. 13 is a flow chart for a method of authorizing and opening the secured storage cabinet.

FIG. 13 depicts the method and logic for the opening of cabinet 21. In some cases only a key code is necessary for an authorized user to open the cabinet 21 and access the weapons. For more secure areas such as a school, a central control signal may be received in addition to a valid security key code being entered as shown.

Figure 14:
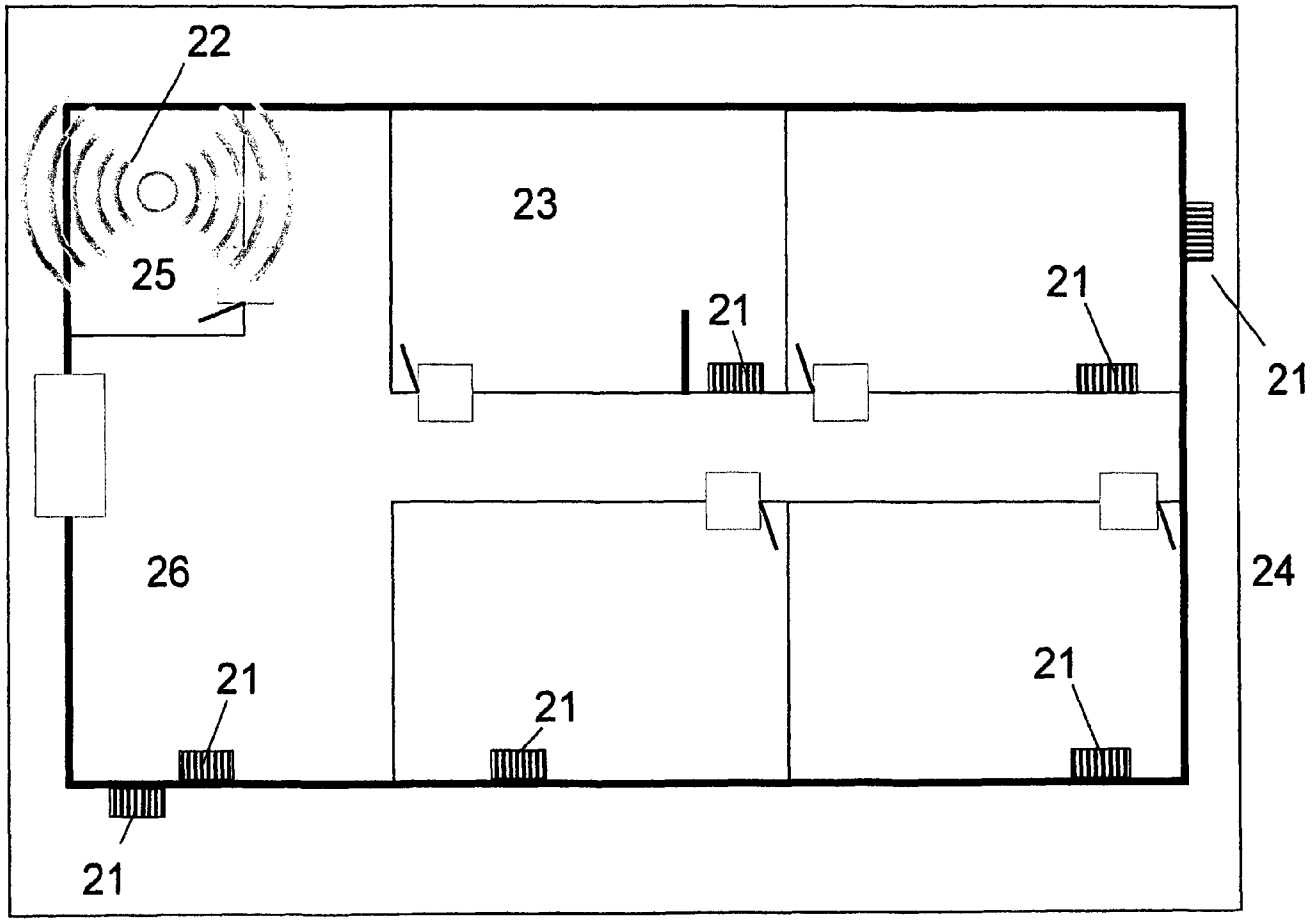
FIG. 14 is a plan view for the placement of secured storage cabinets around a school or institution.

FIG. 14 illustrates an institutional floor plan such as a school. In the case of a school, cabinets 21 are situated at strategic positions in classrooms 23, outside on the grounds 24, and in the entrance hall 26. Central office 25 acts as the central authority and issues alert signal 22 when required.

It is a preferred embodiment of the present invention to provide a means for the authorization of weapons and devices being operated by an individual or group of individuals. It is a further preferred embodiment of the present invention that the authorization given may be determined by time, geographic location, class of weapon, weapon, or any combination thereof.

It is a preferred embodiment of the present invention that authorizable weapons, authorization signal generators and the various central authority signals and other controls be equipped to further regulate the control of authorization by time and location, and that means are provided and incorporated into these devices to determine and monitor the current and historical time and location.

It is a preferred embodiment of the present invention that the skin signals are generated by electromagnetic energy and are generated internally or directly placed on the skin of the individual and delivered to the skin of the individual.

It is a preferred embodiment that the skin signals are electromagnetic signals in the form of a voltage being generated between 0.01 Hertz and 500,000,000,000 Hertz.

While the foregoing description of the invention enables one of ordinary skill to make and use what is considered presently to be the best mode of the invention, it can be appreciated that variations, combinations, and equivalents of the specific embodiment, method, and examples herein can be made. The invention should therefore not be limited by the above described embodiments, but is set forth in the claims below.

What is claimed is:

1. The method of a firearm control and authorization system comprising:

a) a firearm having a frame with a handle, a barrel carried by said frame, and a fire authorization and control system carried by said frame and in operational connection with said barrel, said fire authorization and control system adapted to authorize and allow the discharge of a bullet through said barrel;

b) an authorization and control system being comprised of an authorizable device on the firearm, an authorization generator in contact with an individual, communication between the authorizable device and the authorization generator via the skin of the individual, and a remotely located authorization control;

c) an authorizable device carried by said frame and adapted to receive and evaluate authorizing signals, said authorizing device placing the firearm in an operational, dischargeable condition when said authorizing device receives the predetermined one or more authorizing signals, and placing the firearm in a non-operational, safe condition when said authorizing device does not receive the predetermined one or more authorizing signals;

d) the authorizable device carried by said frame in contact with the skin receiving one or more authorizing signals with at least one authorizing signal being generated by an authorization generator separately located and in contact with the skin, said signal being conducted via the skin from the authorization generator to the authorizable device;

e) the detection of skin contact by the authorization generator;

f) the authorization generator providing an authorization signal when skin contact is detected, said signal being transmitted via the skin, and the authorization generator ceasing the generation of an authorization signal upon loss of skin contact and not resuming generation of an authorization signal until otherwise reauthorized;

g) the detection of the authorization signal by an authorizable device in contact with the skin;

h) said authorizing generator being further controllable by remote means as a radio signal receivable over an area providing simultaneous control and availability of a single or multiple firearms;

i) a radio signal being transmitted from an authorization control providing authorization for the use of firearms;

j) said radio signal authorizing specific types or classes of weapons;

k) the firearm providing video and audio transmission from the firearm to an authorization control;

l) the authorization signal being transmitted and detected through the capacitive, inductive or resistive characteristics or combination of characteristics of the individual;

m) an authorization system authorizing a weapon;

n) an authorization system where the authorized device is a firearm.

2. The method of claim 1 further comprising on and off, authorization and deauthorizeation, control of the authorization generator individually and in combination by means of:

a) a radio signal from an authorization authority b) the entry of a security code, c) by skin contact, loss of skin contact or any combination thereof.

3. The method as in claim 1 wherein the frame further comprises video and audio transmission and recording means.

4. The method of claim 1 in which the authorizing device provides radio and video transmission means of sound, images, and video to an authorization control and the authorization control provides receiving, listening, and viewing means for the radio and video transmission reception.

5. The method of claim 1 where the authorization control is remote from the authorization device facilitating video and audio means for recording and displaying the audio and video transmission from the remotely located authorizeable device.

6. The method of claim 1 providing radio and video transmission means of sound, images, and video to a remotely located authorization control and the authorization control provides receiving, listening, and viewing means for the radio and video transmission reception.

7. The method of claim 1 wherein the weapon is any class or category or type of pistol, rifle, shotgun, air gun, paintball gun, Taser, electrical/electronic weapon, electro-optical device, gas operated, lethal or less lethal, or other weapon.

8. The method of claim 1 further comprising the authorizing signal received from the skin being generated by an ingested authorization generator.

9. The method of claim 1 further comprising the ingested authorization generator being replaced by another ingested authorization generator that takes its authorization to begin generating authorization signals from the signal of the previously ingested authorization generator, the replaced generator then ceasing signal generation.

10. The method of claim 1 further comprising the cessation of the authorizing signal on detection of a change in the body environment indicating removal of the authorization generator or death of the individual to include loss of blood pressure, incident light, cessation of heartbeat, and body temperature.

11. The method of claim 1 further comprising means for multiple and simultaneous authorization and deauthorization of firearms, controlling the use of firearms in activities to include hunters, police and military groups, schools, military establishments, prisons, and the confines of other controlled or restricted facilities or areas.

12. The method of claim 1 further comprising authorization and deauthorization means including time, location, geographic location, history, class of weapon, and combinations thereof for authorization.

13. The method of claim 1 further providing skin signals of electromagnetic energy in the form of voltage ranging from 0.01 hertz to 500 gigahertz.

* * * * *